US010731935B1

(12) United States Patent
Sapio et al.

(10) Patent No.: US 10,731,935 B1
(45) Date of Patent: Aug. 4, 2020

(54) TAKE DOWN RELEASE FOR FIREARM

(71) Applicant: Kimber IP, LLC, Yonkers, NY (US)

(72) Inventors: Daniel Edward Sapio, Bronxville, NY (US); Lucio Ditrolio, Mineola, NY (US); Ronald Richard Dudzic, Jr., Tarrytown, NY (US); Kevin Johnsrud, Morrisville, PA (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 16/358,177

(22) Filed: Mar. 19, 2019

(51) Int. Cl.
*F41A 3/66* (2006.01)
*F41C 3/00* (2006.01)

(52) U.S. Cl.
CPC . *F41A 3/66* (2013.01); *F41C 3/00* (2013.01)

(58) Field of Classification Search
CPC ..... F41A 3/66; F41C 3/00
See application file for complete search history.

(56) References Cited

U.S. PATENT DOCUMENTS 6,263,607 B1 * 7/2001 Fuchs ..... F41A 17/36 42/70.01
6,560,909 B2 * 5/2003 Cominolli ..... F41A 17/46 42/70.05
7,140,141 B2 * 11/2006 Vaid ..... F41A 11/00 42/108
7,392,611 B2 * 7/2008 Curry ..... F41A 11/00 42/106
8,371,058 B2 * 2/2013 Trpcic ..... F41A 17/56 42/108
8,935,872 B2 * 1/2015 Zukowski ..... F41A 17/56 42/70.02
8,950,100 B2 * 2/2015 Nebeker ..... F41A 3/64 42/108
9,303,936 B2 4/2016 Toner
9,714,804 B2 * 7/2017 Singh ..... F41A 17/72
10,429,143 B2 * 10/2019 Zajk ..... F41A 19/30
2002/0194762 A1 * 12/2002 Cominolli ..... F41A 17/46 42/70.06
2011/0162248 A1 * 7/2011 Trpcic ..... F41A 17/56 42/108

(Continued)

*Primary Examiner* — Michelle Clement
(74) *Attorney, Agent, or Firm* — Kaplan Breyer Schwarz, LLP

(57) ABSTRACT

A takedown mechanism for disassembly of a striker-fired pistol, including a takedown release comprising a spring and a pin disposed in the pistol frame adjacent its rear end, the spring to bias the pin towards the barrel end of the frame and disposed against a hard stop on the frame; a takedown bar having a sear contact surface and movable along the longitudinal axis of the frame from a first position to a second position, wherein the takedown release biases the takedown bar towards the barrel end of the frame, wherein, in the first position, the takedown bar is disposed between the takedown release and the slide stop, wherein longitudinal movement of the takedown bar towards the barrel end is limited by the slide stop, wherein, in the second position, the takedown bar is disposed in a forward position toward the barrel end of the frame to cause the sear contact surface on the takedown bar to contact the second leg of the sear to cause the sear to rotate away from the tab of the pistol striker such that the first leg of the sear no longer contacts the tab of the striker.

1 Claim, 8 Drawing Sheets

(56) References Cited

U.S. PATENT DOCUMENTS

| | | | | |
|---|---|---|---|---|
| 2014/0215880 | A1* | 8/2014 | Zukowski | F41A 17/36 42/70.02 |
| 2016/0320155 | A1* | 11/2016 | Singh | F41A 19/12 |
| 2017/0184365 | A1* | 6/2017 | Zajk | F41A 19/32 |
| 2019/0195587 | A1* | 6/2019 | Thomele | F41A 17/60 |
| 2020/0080801 | A1* | 3/2020 | O'Clair | F41C 3/00 |

* cited by examiner

TAKE DOWN RELEASE FOR FIREARM

BACKGROUND OF THE INVENTION

The present invention is directed to striker fired pistols. In particular, the present invention is directed to ease and safety of disassembly of striker fired pistols without requiring the pulling of the trigger of the pistol.

In striker fired pistols, when the pistol is in a battery position, a seer engages the striker (i.e., the pistol element that springs forward to strike a pistol cartridge to discharge the firearm). The seer is caused to rotate by movement of the pistol's trigger. In the past, when disassembly of the pistol is desired, generally, the trigger must be pulled such that the sear releases the striker. However, if proper safety procedures are not taken and the pistol is inadvertently left loaded in the barrel, a dangerous condition may be present. It would be beneficial to have a mechanism to avoid the requirement to pull the trigger to disengage the sear from the striker.

U.S. Pat. No. 9,303,936 (Toner) is one invention that attempts to resolve this issue. Here, the frame assembly includes a takedown safety lever and takedown actuation lever.

Movement of the takedown safety lever causes the sear to be moved such that subsequent slide motion will not result in storage of striker energy. Movement of the takedown safety lever is only possible when the slide is retracted beyond a point at which a chambered round would be ejected. Removal of the slide does not require pulling the trigger.

All references cited herein are incorporated herein by reference in their entireties.

BRIEF SUMMARY OF THE INVENTION

In order to disassemble a striker fired pistol, the striker must be released from the sear. During operation of a striker fired pistol, the striker spring is compressed when the striker engages the sear and recoil spring force returns the slide to battery. At this point, pulling the trigger releases the striker from the sear, and the striker impacts the cartridge primer and ignites, discharging the projectile. This invention eliminates the need to pull the trigger for disassembly, and, by requiring that the slide must be out of battery, the chamber can be checked for the presence of a cartridge.

The takedown mechanism of the present invention allows the pistol to be disassembled without pulling the trigger. The takedown mechanism is activated when the slide is moved rearward and aligned with the slide stop disassembly notch and the slide stop is removed from the frame. This allows the takedown bar to move forward under spring force contacting the sear and rotating it to the sear's released position. By moving the slide rearward, the striker energy is dissipated, and the striker is no longer in contact with the sear. With the sear rotated out of the path of the striker, the slide can be removed by sliding it forward off the frame rails.

The takedown mechanism for disassembly of a striker-fired pistol is provided as follows. The pistol includes a frame having a barrel end, a rear end, and a longitudinal axis extending between the barrel end and the rear end. A slide is disposed on the frame and a striker is disposed in the frame. The striker has a tab depending downward therefrom. A sear having a body having a first leg and a second leg is rotationally disposed in the frame about a pivot point located adjacent to the rear end of the frame, perpendicular to the longitudinal axis of the frame. The first leg of the sear is for contacting the tab of the striker. A slide stop is disposed in the frame generally perpendicular to the longitudinal axis of the frame, and is disengageable to facilitate disassembly of the slide from the frame.

The takedown mechanism includes a takedown release including a spring and a pin and is disposed in the frame adjacent to the rear end of the frame. The spring biases the pin towards the barrel end of the frame and is disposed against a hard stop on the frame adjacent to the rear end of the frame. The takedown mechanism further includes a takedown bar having a first end, a second end and a sear contact surface. The takedown bar is disposed in the frame and is movable along the longitudinal axis of the frame from a first position to a second position. The takedown release biases the takedown bar towards the barrel end of the frame. In the first position, the takedown bar is disposed between the takedown release and the slide stop and wherein longitudinal movement of the takedown bar towards the barrel end is limited by the slide stop. In the second position, the takedown bar is disposed in a forward position toward the barrel end of the frame to cause the sear contact surface on the takedown bar to contact the second leg of the sear to cause the sear to rotate away from the tab of the striker such that the first leg of the sear no longer contacts the tab of the striker.

When the slide is in battery position with the slide stop disposed in the frame, the takedown bar is in the first position wherein the first leg of the sear is in contact with the tab of the striker. When the slide stop is disengaged, the takedown bar is in the second position wherein the sear contact surface on the takedown bar contacts the second leg of the sear to cause the sear to rotate away from the tab of the striker.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
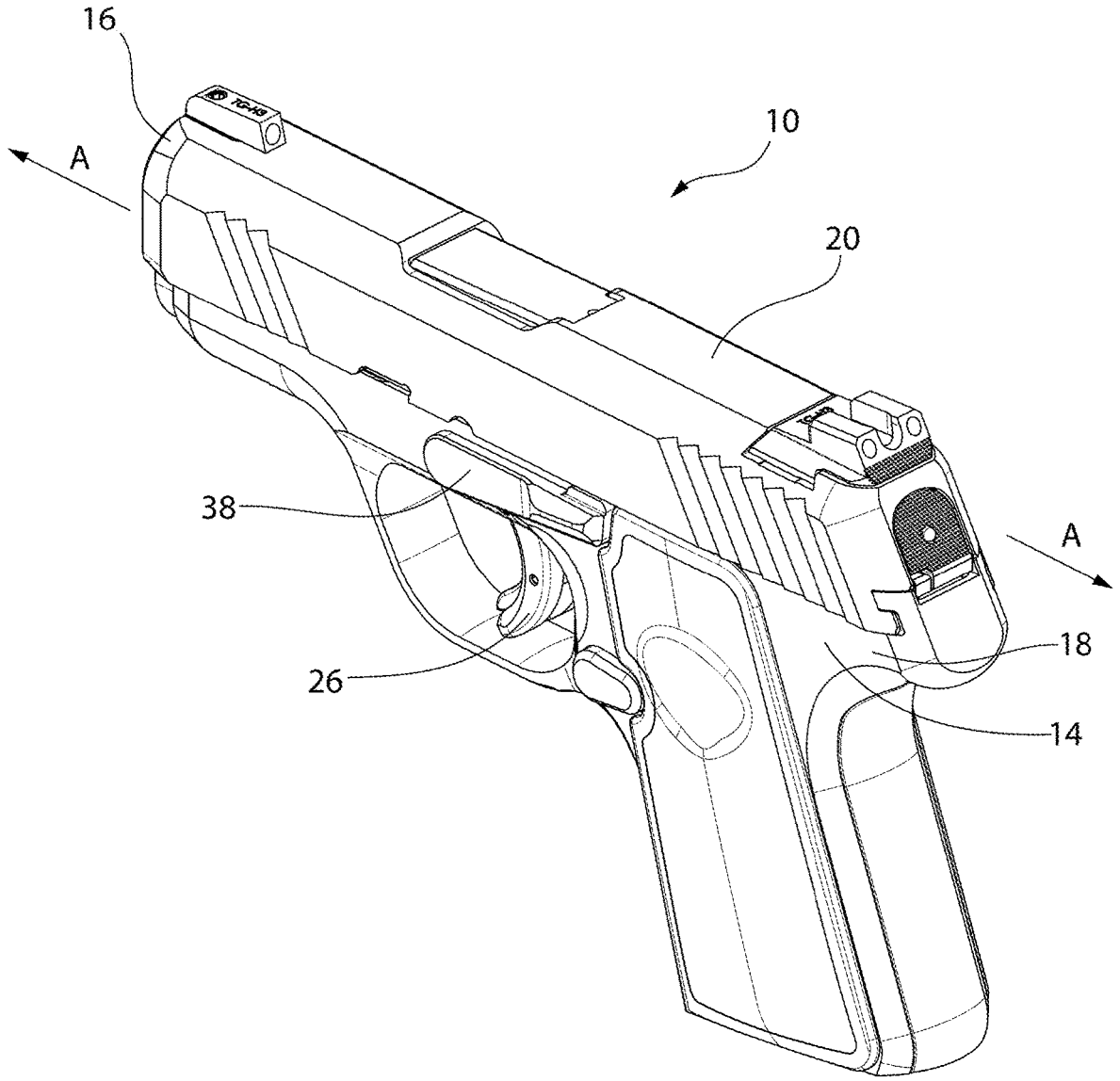
FIG. 1 is an isometric view of a striker fired pistol having a takedown release mechanism in accordance with an exemplary embodiment of the present invention.
Figure 2:
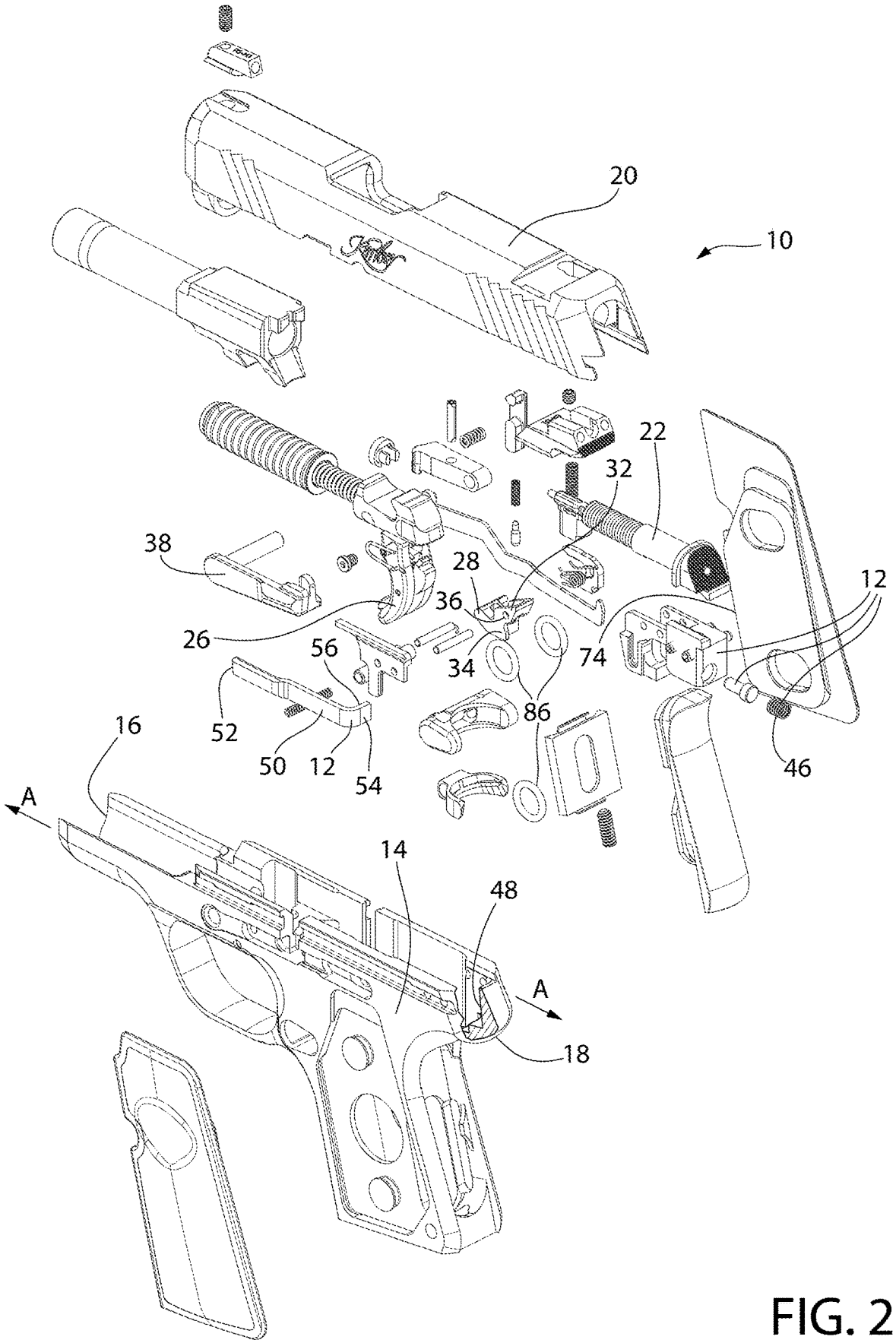
FIG. 2 is an exploded isometric view of the striker fired pistol having the takedown release mechanism of FIG. 1.

The invention will be illustrated in more detail with reference to the following embodiment, but it should be understood that the present invention is not deemed to be limited thereto.

Referring now to the drawing figures, wherein like part numbers refer to like elements throughout the several views, there is shown in FIGS. 1-8 a striker-fired pistol 10 having a takedown mechanism 12 for disassembly of the pistol 10 in accordance with an exemplary embodiment of the present invention. The pistol 10 includes a frame 14 having a barrel end 16, a rear end 18, and a longitudinal axis A extending between the barrel end 16 and the rear end 18.

The pistol 10 further includes a slide 20 disposed on the frame 14, a striker 22 disposed in the frame 14 having a tab 24 depending downwardly, a trigger 26 disposed in the frame 14, and a sear 28. The sear 28 has a body 30 having a first leg 32 and a second leg 34. The sear 28 is rotationally disposed in the frame 14 about a pivot point 36 located adjacent to the rear end 18 of the frame 14 and perpendicular to the longitudinal axis A of the frame 14. The first leg 32 is for contacting the tab 24 of the striker 22, as is typical for striker fired pistols.

Figure 3:
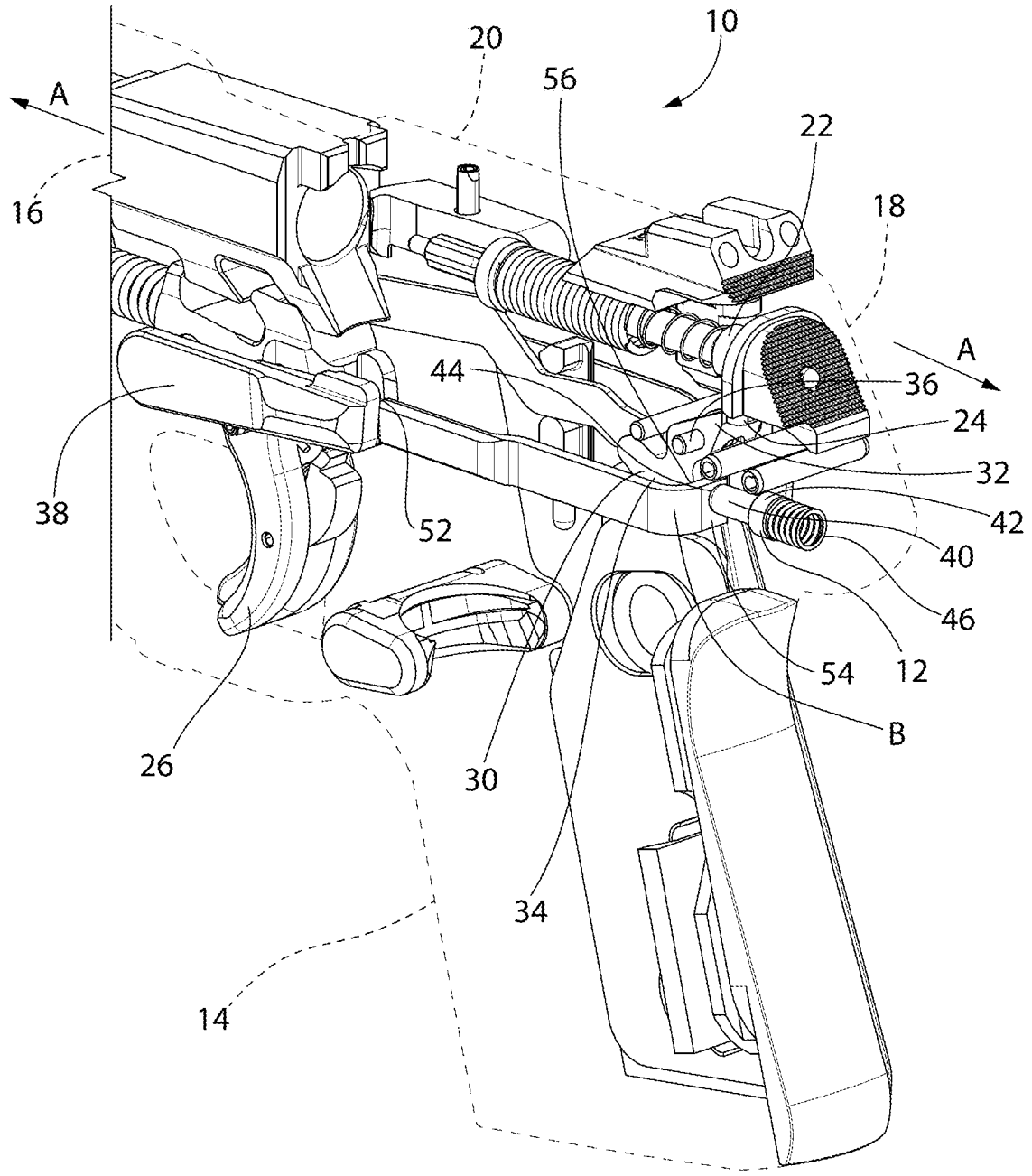
FIG. 3 is a partial isometric view of the striker fired pistol having the takedown release mechanism of FIG. 1, shown with the its frame and numerous other elements removed for clarity, shown with the pistol in a battery position.
Figure 4:
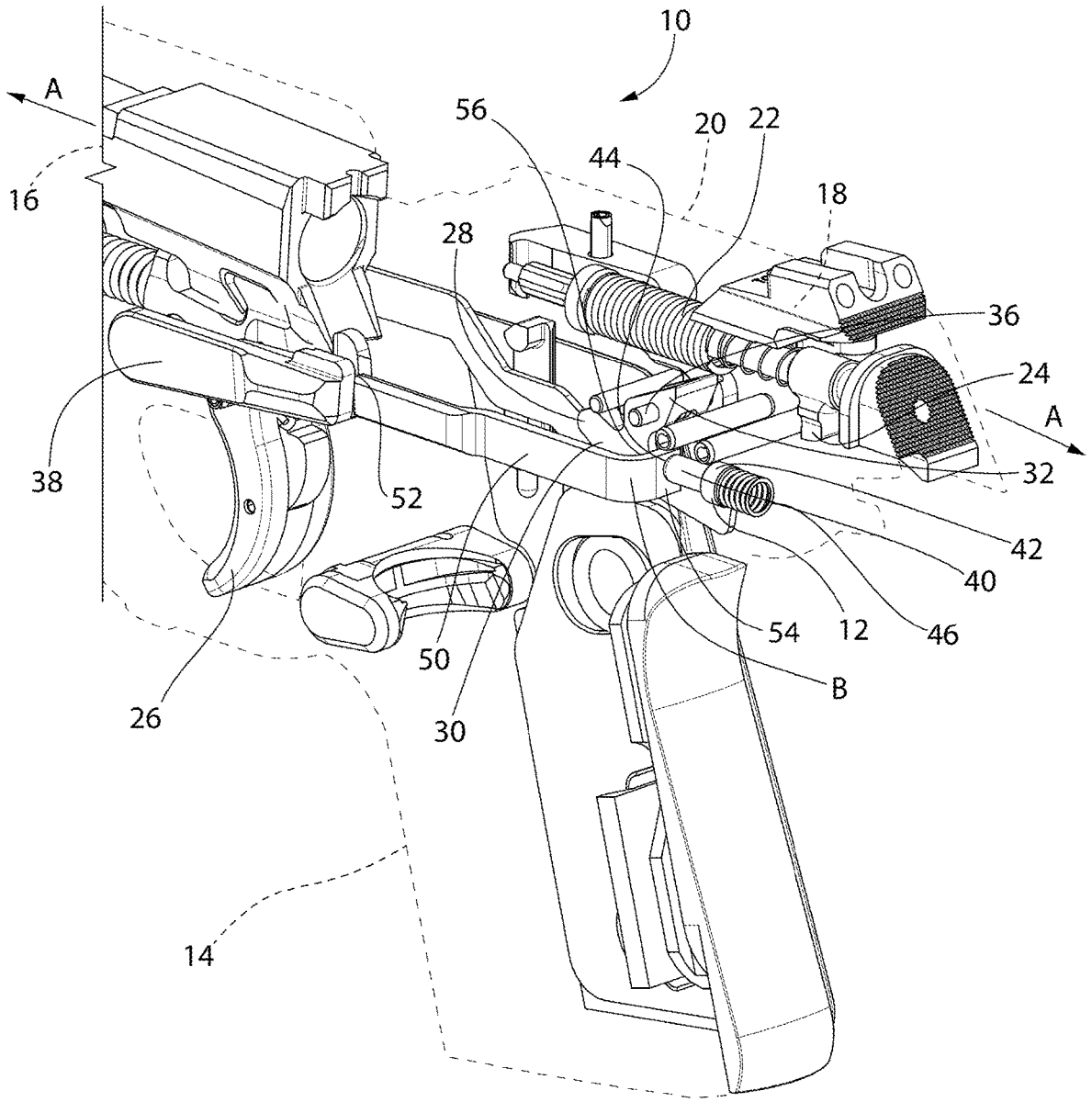
FIG. 4 is a partial isometric view of the striker fired pistol having the takedown release mechanism of FIG. 1, shown with the its frame and numerous other elements removed for clarity, with elements shown in positions where the slide of the pistol is in a rearmost, slide lock position, with a slide stop engaged in the frame.
Figure 5:
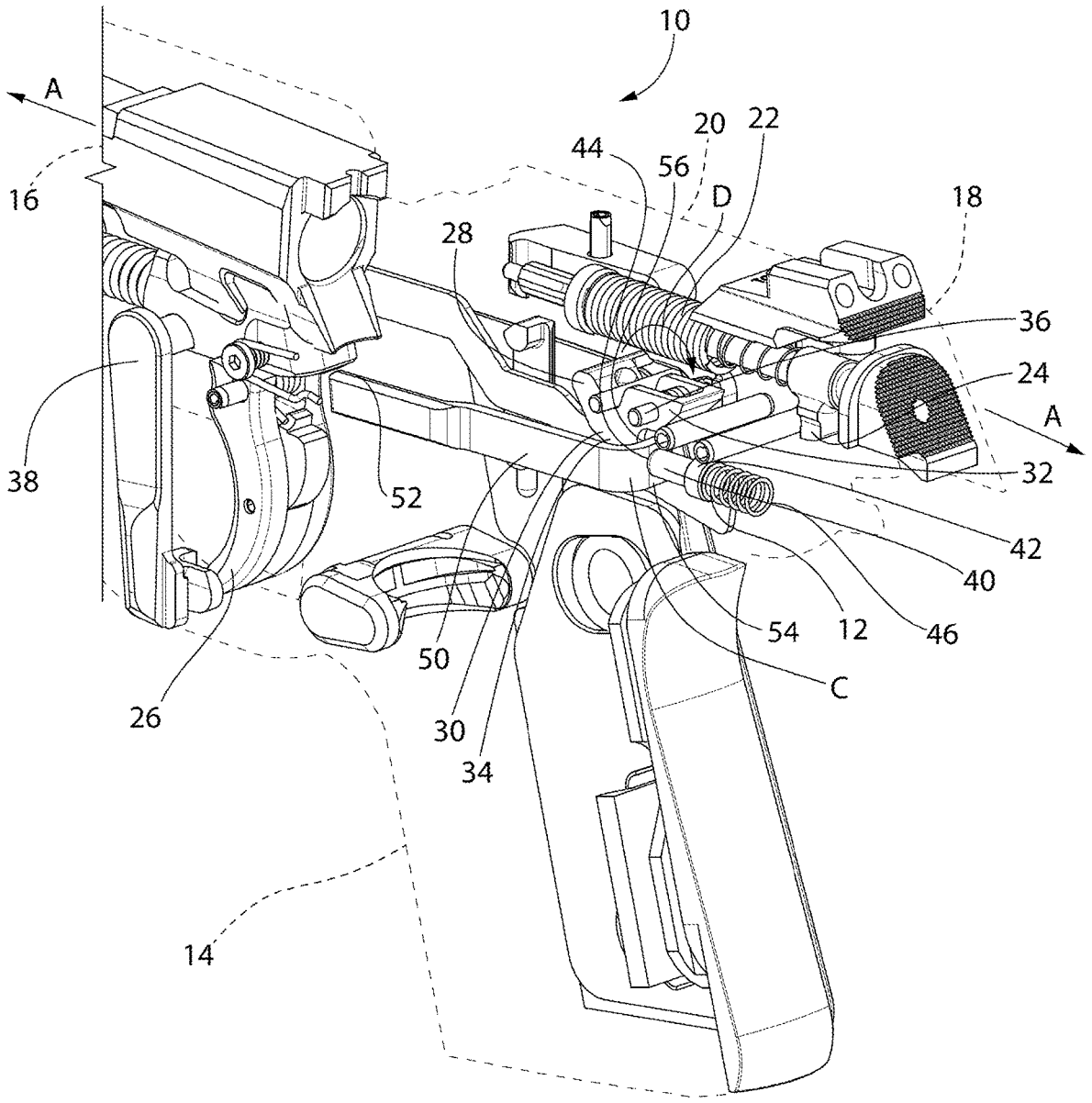
FIG. 5 is a partial isometric view of the striker fired pistol having the takedown release mechanism of FIG. 1, shown with the its frame and numerous other elements removed for clarity, with elements shown in positions where the slide of the pistol is in a rearmost, slide lock position, with a slide stop disengaged from the frame.
Figure 6:
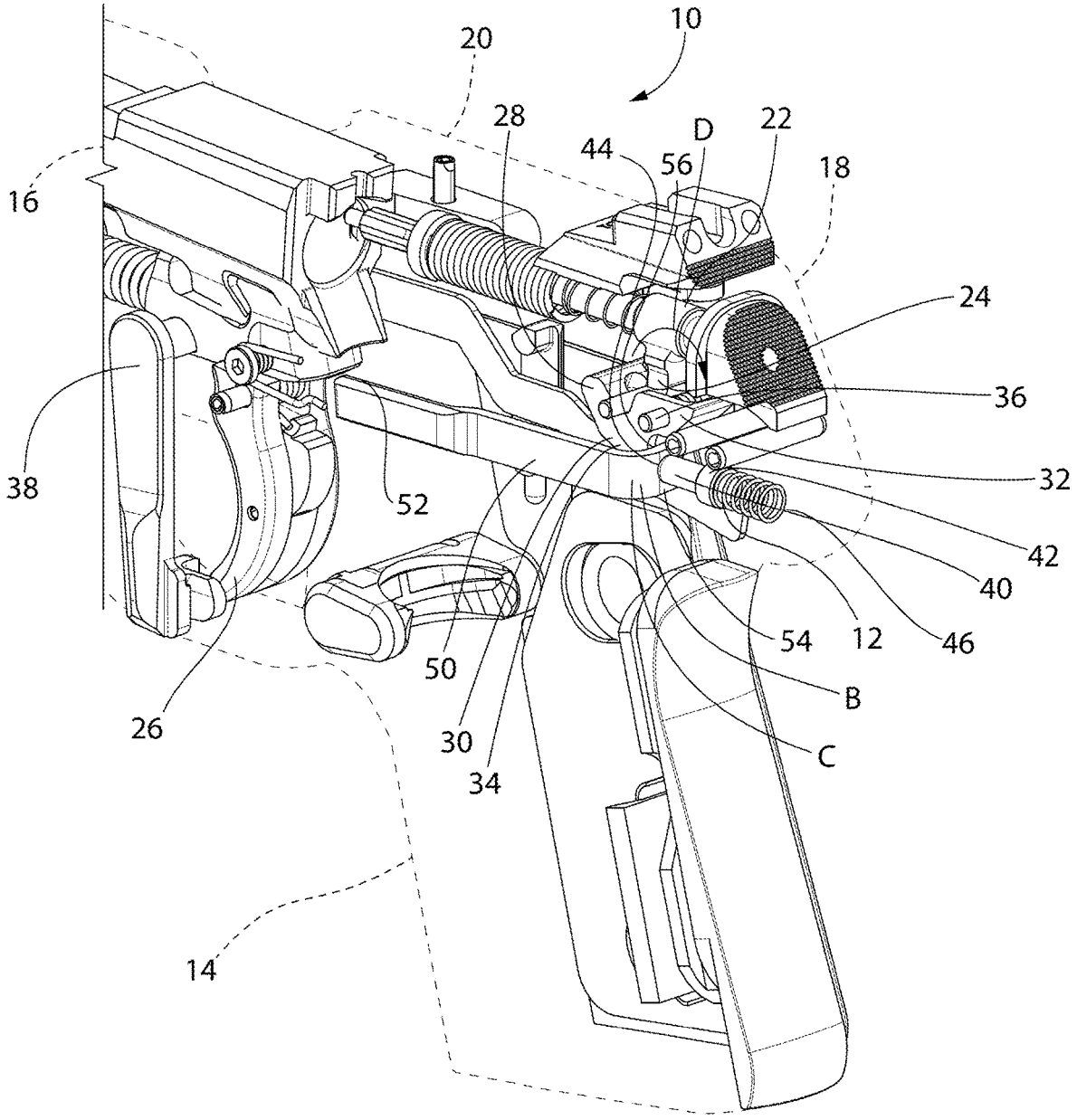
FIG. 6 is a partial isometric view of the striker fired pistol having the takedown release mechanism of FIG. 1, shown with the its frame and numerous other elements removed for clarity, with elements shown in positions where the slide is moved forward for disassembly of the pistol with the slide stop disengaged.
Figure 7:
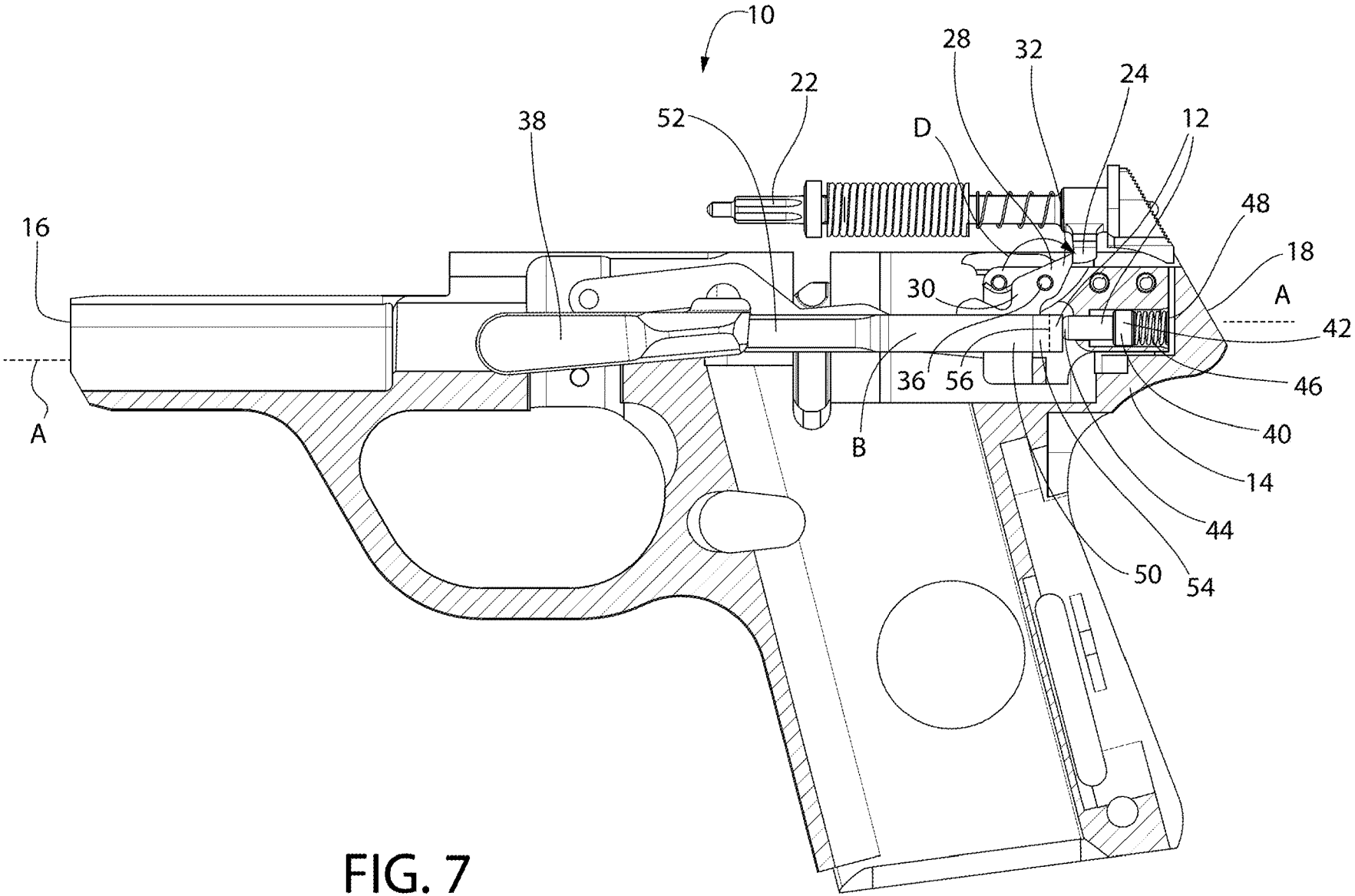
FIG. 7 is a side elevation view of the striker fired pistol having the takedown release mechanism of FIG. 1, shown with numerous other elements removed for clarity, shown with the pistol in a battery position similar to that of FIG. 3.
Figure 8:
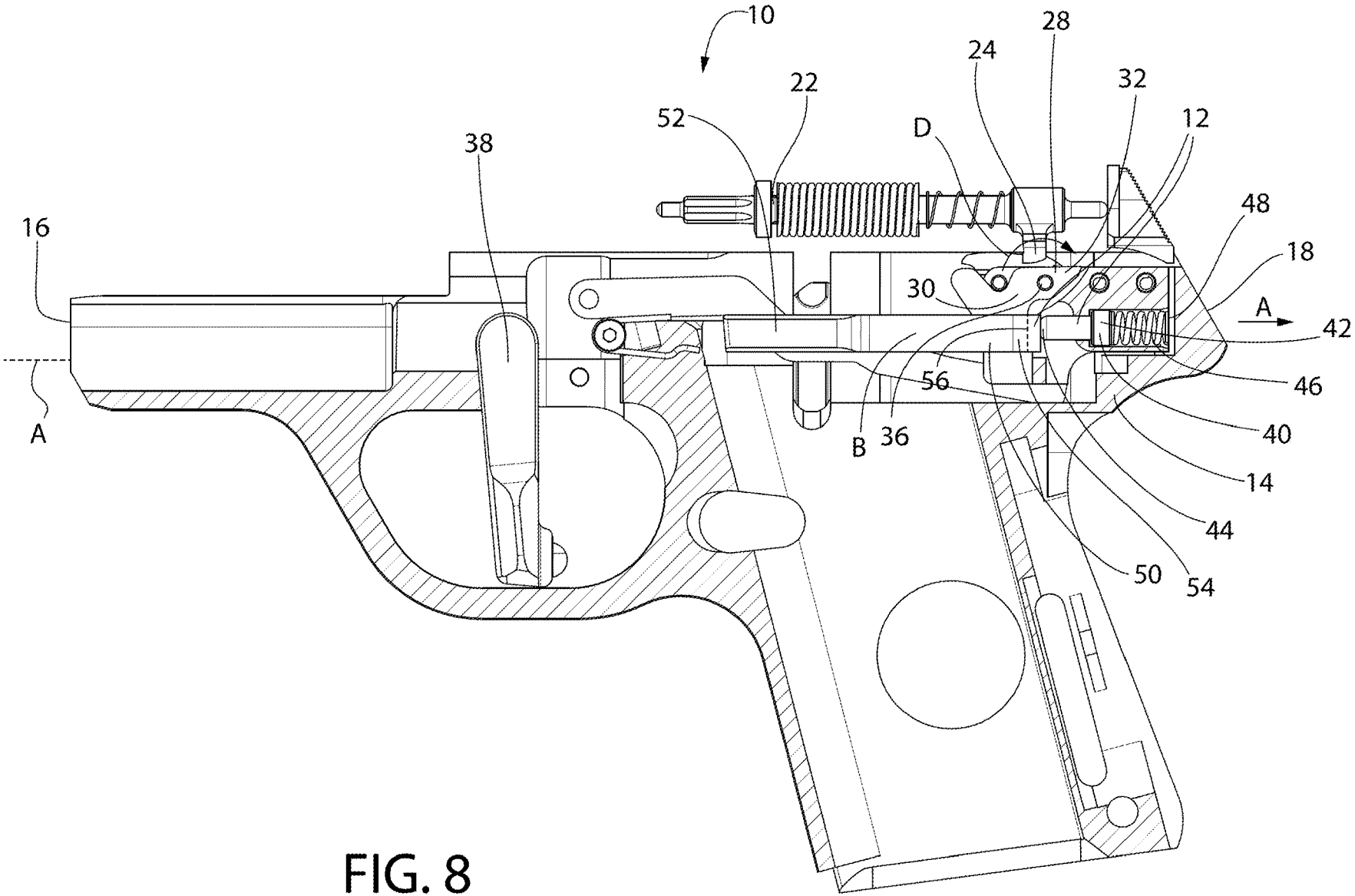
FIG. 8 is a side elevation view of the striker fired pistol having the takedown release mechanism of FIG. 1, shown with numerous other elements removed for clarity, with elements shown in positions where the slide is moved forward for disassembly of the pistol with the slide stop disengaged, similar to that of FIG. 6.

As best seen in FIGS. 3, 4 and 7, a slide stop 38 (again, as is typical for striker fired pistols) is disposed in the frame 14 generally perpendicular to the longitudinal axis A of the frame 14. The slide stop 38 is disengageable (e.g., removable or otherwise moveable to a position incapable of functioning as a slide stop) to facilitate disassembly of the slide 20 from the frame 14. Physical removal of the slide stop 38 from the frame 14 may or may not be required.

As can be seen in FIGS. 2-8, the takedown mechanism 12 includes a takedown release 40 having a pin 44 and a spring 46 (or other biasing means or member to urge the pin 44 toward the barrel end 16 of the pistol 10). The takedown release 40 is disposed in the frame 14 adjacent to the rear end 18 of the frame 14 and biases its pin 44 towards the barrel end 16 of the frame 14. The spring 46 is disposed against a hard stop 48 (see FIGS. 7 and 8) on the frame 14 adjacent to the rear end 18 of the frame 14 to urge the end 42 of the pin 44 toward the barrel end 16 of the frame 14.

A takedown bar 50 is provided, having a first end 52, a second end 54 and a sear contact surface 56. The takedown bar 50 is disposed in the frame 14 and movable along the longitudinal axis A of the frame 14 from a first position B (see FIGS. 3, 4 and 7 where the slide stop 38 is engaged in the frame 14) to a second position C (see FIGS. 5, 6 and 8 where the slide stop 38 is removed or disengaged from the frame 14). The takedown release 40 biases the takedown bar 50 towards the barrel end 16 of the frame 14 and causes the takedown bar 50 to move when the slide stop 38 is disengaged from the frame. In the first position B, the takedown bar 50 is disposed between the takedown release 40 and the slide stop 38 (i.e., the first end 52 of the takedown bar 50 contacts the slide stop 38 and the second end 54 of the takedown bar 50 contacts the pin 44 of the takedown release 40), wherein longitudinal movement of the takedown bar 50 towards the barrel end 16 is limited by the slide stop 38. In the second position C, when the slide stop 38 is disengaged, the takedown bar 50 moves toward the barrel end 16 of the frame 15 to cause the sear contact surface 56 on the takedown bar 50 to contact the second leg of 34 the sear 28 to cause the sear 28 to rotate (in direction D; see FIGS. 5, 6 and 8) away from the tab 24 of the striker 22 such that the first leg 32 of the sear 28 can no longer contact the tab 24 of the striker 22, providing for disassembly of the slide 20 from the frame 14 without the need to press the trigger 26.

When the slide 20 is in battery position (see FIGS. 3 and 7) with the slide stop 38 properly engaged in the frame 14, the takedown bar 50 is in the first position B (see FIGS. 3 and 7) wherein the first leg 32 of the sear 28 is in contact with the tab 24 of the striker 22. When the slide stop 38 is disengaged (e.g., removed), the takedown bar 50 is in the second position C wherein the sear contact surface 56 of the takedown bar 50 contacts the second leg 34 of the sear 28 to cause the sear 28 to rotate away from the tab 24 of the striker 22, providing for disassembly of the slide 20 from the frame 14 without the need to press the trigger 26.

While the invention has been described in detail and with reference to specific embodiments thereof, it will be apparent to one skilled in the art that various changes and modifications can be made therein without departing from the spirit and scope thereof.

What is claimed is:

1. A takedown mechanism for disassembly of a striker-fired pistol, the pistol comprising:

(a) a frame having a barrel end, a rear end, and a longitudinal axis extending between the barrel end and the rear end;

(b) a slide disposed on the frame;

(c) a striker disposed in the frame, having a tab depending downward therefrom;

(d) a sear having a body having a first leg and a second leg, the sear rotationally disposed in the frame about a pivot point located adjacent to the rear end of the frame and perpendicular to the longitudinal axis of the frame, the first leg for contacting the tab of the striker;

(e) a slide stop disposed in the frame generally perpendicular to the longitudinal axis of the frame, said slide stop being disengageable to facilitate disassembly of the slide from the frame, and (f) the takedown mechanism comprising:

(i) a takedown release comprising a spring and a pin, the takedown release disposed in the frame adjacent to the rear end of the frame, the spring to bias the pin towards the barrel end of the frame, the spring disposed against a hard stop on the frame adjacent to the rear end of the frame;

(ii) a takedown bar having a first end, a second end and a sear contact surface, the takedown bar disposed in the frame and movable along the longitudinal axis of the frame from a first position to a second position, wherein the takedown release biases the takedown bar towards the barrel end of the frame, wherein, in the first position, the takedown bar is disposed between the takedown release and the slide stop, wherein longitudinal movement of the takedown bar towards the barrel end is limited by the slide stop, wherein, in the second position, the takedown bar is disposed in a forward position toward the barrel end of the frame to cause the sear contact surface on the takedown bar to contact the second leg of the sear to cause the sear to rotate away from the tab of the striker such that the first leg of the sear no longer contacts the tab of the striker;

wherein, when the slide is in battery position with the slide stop engaged in the frame, the takedown bar is in the first position wherein the first leg of the sear is in contact with the tab of the striker and wherein, when the slide stop is disengaged, the takedown bar is in the second position wherein the sear contact surface on the takedown bar contacts the second leg of the sear to cause the sear to rotate away from the tab of the striker.

* * * * *